US007603952B2

(12) United States Patent
Vetesnik

(10) Patent No.: US 7,603,952 B2
(45) Date of Patent: Oct. 20, 2009

(54) TROLLEY AND RAIL APPARATUS FOR USE IN FALL PROTECTION AND SIMILAR APPLICATIONS

(75) Inventor: Jan Vetesnik, Winnipeg (CA)

(73) Assignee: Captial Safety Group Winnipeg Ltd., Winnipeg, Manitoba (CA)

( * ) Notice: Subject to any disclaimer, the term of this patent is extended or adjusted under 35 U.S.C. 154(b) by 343 days.

(21) Appl. No.: 11/183,241

(22) Filed: Jul. 18, 2005

(65) Prior Publication Data

US 2006/0156944 A1 Jul. 20, 2006

(51) Int. Cl.
*B61B 12/02* (2006.01)
*B61B 3/00* (2006.01)

(52) U.S. Cl. ..... 104/106; 105/148

(58) Field of Classification Search ..... 104/106, 104/107, 111, 89, 91; 105/148, 154, 155, 105/30, 32, 73

See application file for complete search history.

(56) References Cited

U.S. PATENT DOCUMENTS 4,471,867 A * 9/1984 Forshee ..... 198/687
4,531,460 A * 7/1985 Pamer ..... 105/150
5,881,650 A * 3/1999 Gersemsky et al. ..... 105/154
6,058,849 A * 5/2000 Ostholt et al. ..... 104/93
6,269,904 B1 8/2001 Morhaus
6,334,507 B1 1/2002 Westerweel
D459,839 S 7/2002 Blackford
6,478,112 B2 11/2002 Lee

* cited by examiner

*Primary Examiner*—S. Joseph Morano
*Assistant Examiner*—Robert J McCarry, Jr.
(74) *Attorney, Agent, or Firm*—IPLM Group, P.A.

(57) ABSTRACT

The present invention relates to a rail and trolley apparatus having a trolley movable along a horizontally supported rail assembly for use as a fall protection or other load supporting system. The trolley is provided with pairs of wheels arranged to engage opposing bearing surfaces in each of two channels provided in the rail assembly. Each bearing surface has a central portion and two side portions shaped to fit flush against a curved edge surface of each wheel. This allows the wheels to bear against the surfaces in multiple directions, thereby allowing rolling motion of the trolley along the rail assembly as well as loading of the trolley in any direction not parallel to said motion. As a result, the apparatus can be oriented at any angle about a longitudinal axis thereof during installation, adding to the versatility and adaptability of the apparatus.

18 Claims, 9 Drawing Sheets

TROLLEY AND RAIL APPARATUS FOR USE IN FALL PROTECTION AND SIMILAR APPLICATIONS

The present invention relates to a rail and trolley apparatus having a trolley movable along a horizontally supported rail assembly for use as a fall protection or other load supporting system.

BACKGROUND

Fall protection systems, or fall arrest systems, are commonly used in industry to prevent accidents involving falls from elevated work environments, like rooftops. Workers wear a harness that is attached to a support assembly by means of a cable known as a lanyard or "lifeline." Should a worker accidentally go over the edge of an elevated surface wearing such a harness, the lifeline will suspend the worker from the support assembly, preventing a fall to the ground below.

Common fall protection systems include rail assemblies and cable assemblies, in which a trolley or anchor is arranged for movement along a horizontal rail or cable which is supported above the elevated structure on which work is being performed. This arrangement provides protection from a substantial vertical fall while allowing the worker the freedom to move around the elevated surface.

U.S. Pat. No. 6,269,904 discloses a rail assembly having an I-beam supported on the bottom of a truss member which is mounted between support members over the elevated surface being worked on. A trolley is provided with wheels arranged to engage an upper side of the bottom flange of the I-beam such that the trolley can move along the I-beam in response to movement of the attached worker.

U.S. Pat. No. 6,334,507 discloses a cable assembly having parallel and generally horizontal anchoring lines spaced apart above the elevated surface. A trolley is provided with rollers arranged to allow movement along the longitudinal anchoring lines.

U.S. Pat. No. 6,478,112 discloses a rail and anchor system in which a sliding anchor comprises two members, one for each side of a crowned rail, each having a rail engaging portion and a connector portion. A hook at the end of the lanyard serves to both connect the two members of the anchor and secure the worker to the anchor by means of aligned openings in the connector portions of the anchor members. The engagement portions of the members are shaped to form a cavity that envelopes the crown of the rail when the members are connected.

The truss and cable supported systems of U.S. Pat. Nos. 6,269,904 and 6,334,507 respectively are designed to be supported in a specific orientation for loading in a predetermined direction. They are arranged to handle downward forces by means of an overhead support assembly. While the rail and anchor system provides for loading in a transverse direction, it lacks the smooth rolling motion of a trolley based system. In each case, the system is intended for a particular mounting arrangement that may be ideal for one use, but not another. As a result, there is a need for a fall protection system that can handle loading in multiple directions such that it can be mounted in a number of different orientations in order to be versatile enough to use for different applications.

SUMMARY

According to a first aspect of the present invention there is provided an apparatus comprising:

a longitudinal rail assembly mounted on support members, said members arranged such that said rail assembly is generally horizontal;

a trolley for carrying a load, said trolley being movable along the rail assembly;

the trolley comprising a body, a center pair of wheels and two side pairs of wheels, said center pair being disposed in a radial space between said side pairs, each pair being rotatable about a respective axis, the wheels of each pair being disposed on opposite sides of said body;

the rail assembly having two longitudinal channels therein, each channel arranged to receive a respective one wheel of each pair;

the channels being laterally spaced such that the body of the trolley can be received therebetween for movement therealong;

each channel being defined by at least a first bearing surface and a second bearing surface, said bearing surfaces being arranged opposite one another;

each bearing surface comprising a central section and two side sections, each side section being disposed on an opposite side of said central section, the side sections of the first bearing surface extending toward the second bearing surface and vice versa;

each wheel being of a shape such that said wheel engages the central and side sections of one of the bearing surfaces, thereby resisting loading of the trolley in multiple directions;

wherein a distance between the central sections of the first and second bearing surfaces of each channel is greater than a diameter of the respective one wheel of each pair such that said wheel engages only one of said bearing surfaces, thereby allowing rotation of said wheel for movement of the trolley along the rail assembly;

the axis of each side pair of wheels intersecting with a first longitudinal axis of the rail assembly and the axis of the center pair of wheels intersecting with a second longitudinal axis of said rail assembly, said longitudinal axes being spaced apart such that said side pairs engage the first bearing surface and said central pair engages the second bearing surface.

The present invention improves on the limited mounting capabilities of the prior art through its ability to handle loading of the trolley in multiple directions, without sacrificing a smooth rolling motion along the rail assembly. In the prior art fall protection systems using trolleys, each wheel of the trolleys engaged either a single flat surface, such as the flange of an I-beam, or a single thin cable. In the present invention, the opposing bearing surfaces of each channel have a central portion located between two side portions. This allows the wheels to bear against the rail members in multiple directions and therefore handle loading in those same directions. The horizontally supported rail assembly can therefore be mounted at any angular orientation about a longitudinal axis thereof. Having each wheel engage only one of the bearing surfaces allows rotation of the wheels within the channel, causing a smooth rolling motion along the rail assembly.

Preferably the rail assembly comprises two longitudinal rail members each having a respective one of the two channels therein.

Preferably each longitudinal rail member comprises an extruded rail member.

Preferably the rail assembly further comprises a longitudinal mounting member, said longitudinal mounting member being attached to each of the two rail members.

Preferably the longitudinal mounting member comprises an extruded mounting member.

Preferably the longitudinal mounting member is attached to the support members for supporting the rail assembly.

Preferably each longitudinal rail member comprises a shoulder portion for engagement with the longitudinal mounting member.

Preferably each longitudinal rail member comprises a channel portion having a generally C-shaped cross section, said channel portion having an inside surface defining the first and second bearing surfaces of the respective channel.

Preferably the C-shaped cross section of the channel portion of each longitudinal rail member defines an open side of said rail member, the longitudinal rail members being arranged such that the open sides of said rail members face one another.

Preferably the longitudinal mounting member comprises a cross section having a generally rectangular perimeter.

Preferably the rail members are bolted to the longitudinal mounting member.

Preferably the rail members are bolted to the longitudinal mounting member through the shoulder portion of each rail member.

There may be provided a lanyard supported on the trolley for connecting the load being carried to said trolley. In this case there may also be provided a harness supported on the lanyard for engaging the load being carried and connecting said load to said lanyard. These features are provided for the use of the apparatus as a fall protection system. In this case, a worker wears the harness while working on an elevated surface so that the lanyard connecting the harness and trolley will arrest an accidental fall while the rolling motion of the trolley allows the worker to move about the elevated surface.

Preferably the trolley body comprises a generally flat plate.

Preferably the trolley body has a hole therein such that the load can be connected to the trolley by means of said hole.

There may be provided a rigid member extending upward from the trolley body for providing a connection point above the trolley to which the load can be connected. This feature is provided for use of the invention in cases where it is desirable to support the load from a elevation higher than that of the trolley.

According to a second aspect of the invention, there is provided an apparatus comprising:

a longitudinal rail assembly mounted on support members, said members arranged such that said rail assembly is generally horizontal;

a trolley for carrying a load, said trolley being movable along the rail assembly;

the trolley comprising a body having at least three pairs of wheels supported thereon, said pairs of wheels being radially spaced apart, each pair being rotatable about a respective axis, the wheels of each pair being disposed on opposite sides of said body;

the rail assembly having two longitudinal channels therein, each channel arranged to receive a respective one wheel of each pair;

the channels being laterally spaced such that the body of the trolley can be received therebetween for movement therealong;

each channel being defined by at least a first bearing surface and a second bearing surface, said bearing surfaces being arranged opposite one another;

each bearing surface comprising a central section and two side sections, each side section being disposed on an opposite side of said central section, the side sections of the first bearing surface extending toward the second bearing surface and vice versa;

each wheel being of a shape such that said wheel engages the central and side sections of one of the bearing surfaces, thereby resisting loading of the trolley in multiple directions;

wherein a distance between the central sections of the first and second bearing surfaces of each channel is greater than a diameter of the respective one wheel of each pair such that said wheel engages only one of said bearing surfaces, thereby allowing rotation of said wheel for movement of the trolley along the rail assembly;

the axes of the pairs of wheels being arranged such that at least one pair of wheels engaging the second bearing surface is located in a radial space between two nonadjacent pairs of wheels engaging the first bearing surface.

BRIEF DESCRIPTION OF THE DRAWINGS

In the accompanying drawings, which illustrate exemplary embodiments of the present invention.

DETAILED DESCRIPTION

The apparatus according to the present invention is the "Glide 360" rail system having a trolley arranged for movement along a longitudinal rail assembly supported in a generally horizontal manner. The rail assembly and trolley have been designed such that the wheels of the trolley can bear against multiple surfaces of the rail and therefore handle loading of the trolley in multiple directions. As a result, the apparatus is operable regardless of the rail assembly's angular orientation about a longitudinal axis thereof. The apparatus can be used as part of a fall protection system or in other applications where it is desirable to support a load and allow linear motion along a rail.

Figure 1:
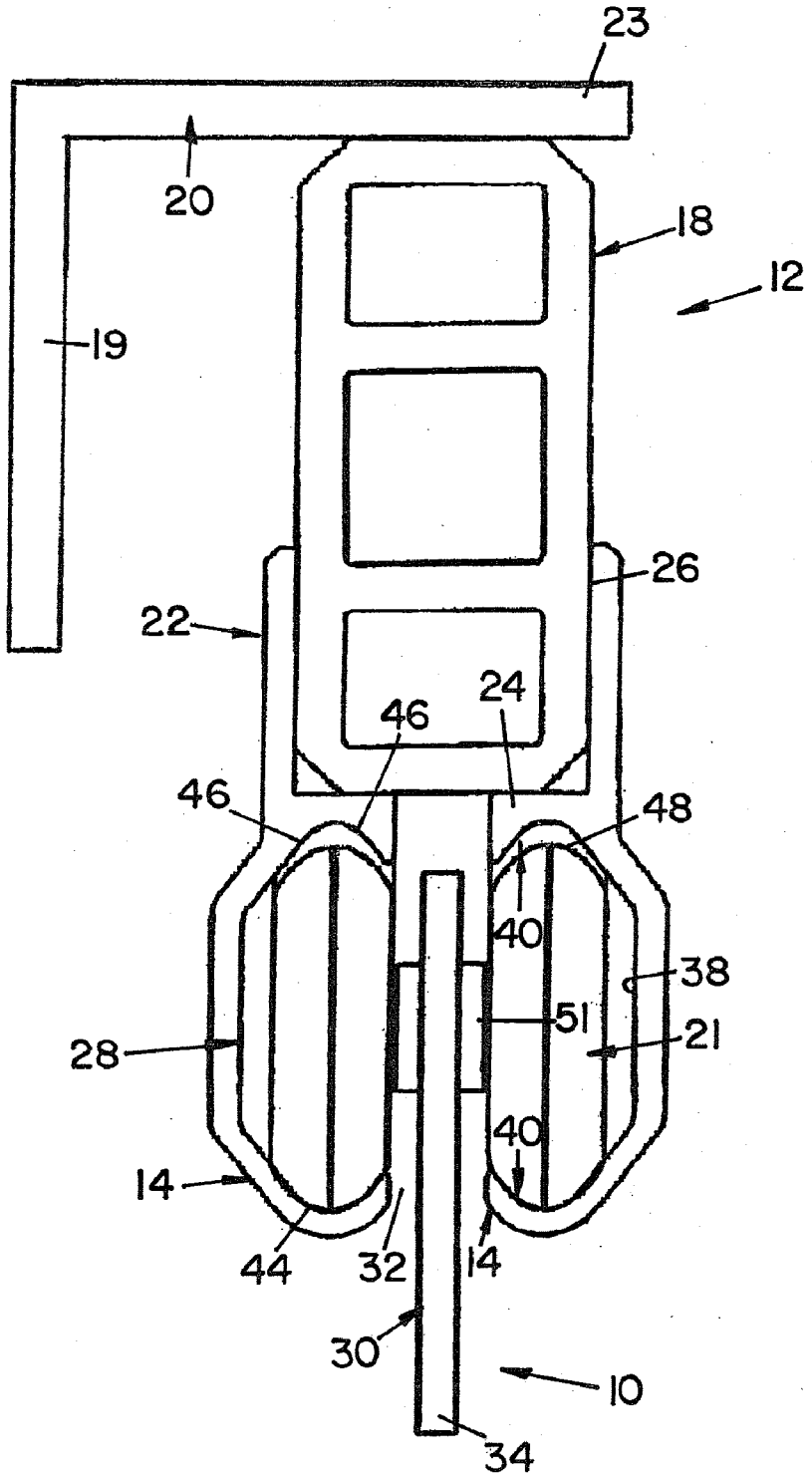
FIG. 1 is an end elevational view of the apparatus according to a first embodiment of the present invention.
Figure 2:
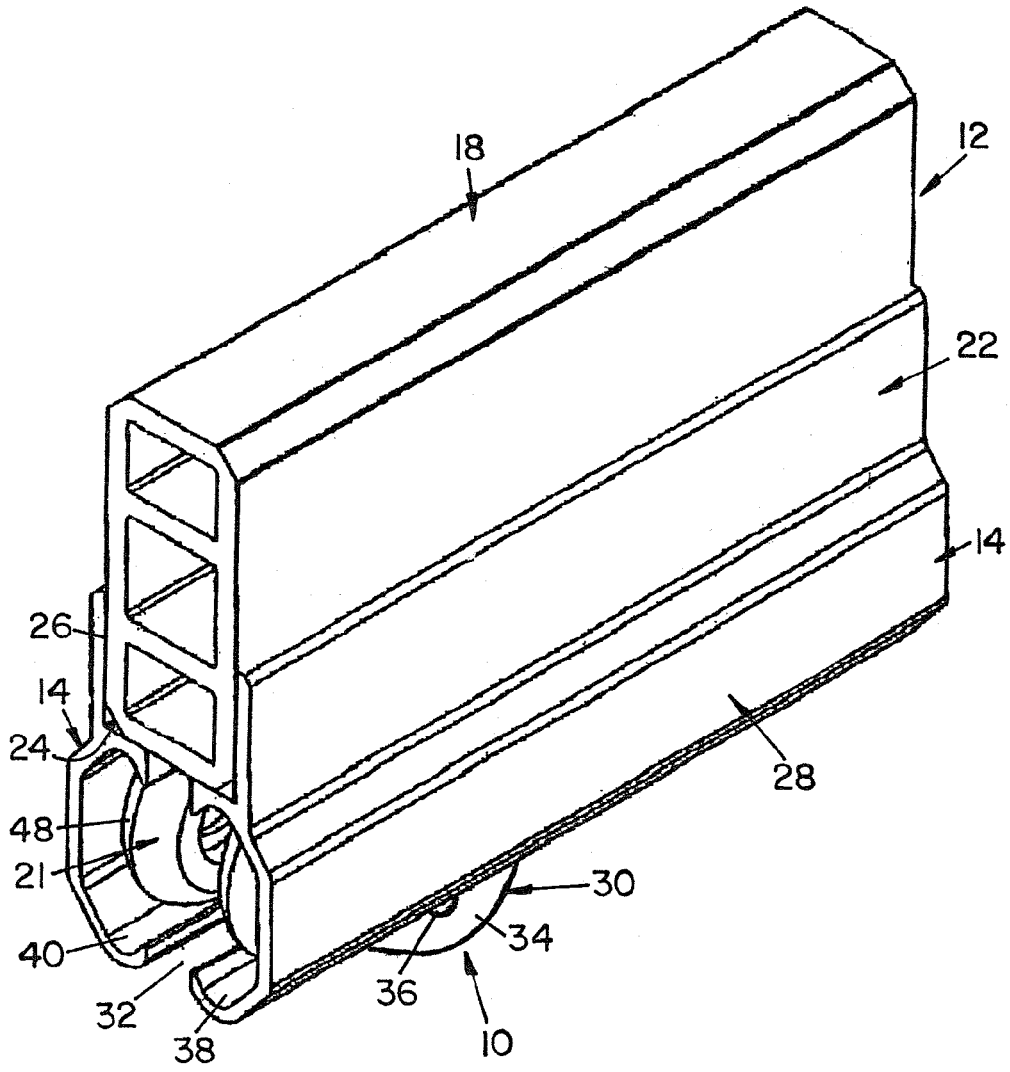
FIG. 2 is an isometric view of the trolley and the rail assembly of the apparatus according to the first embodiment of the present invention.
Figure 3:
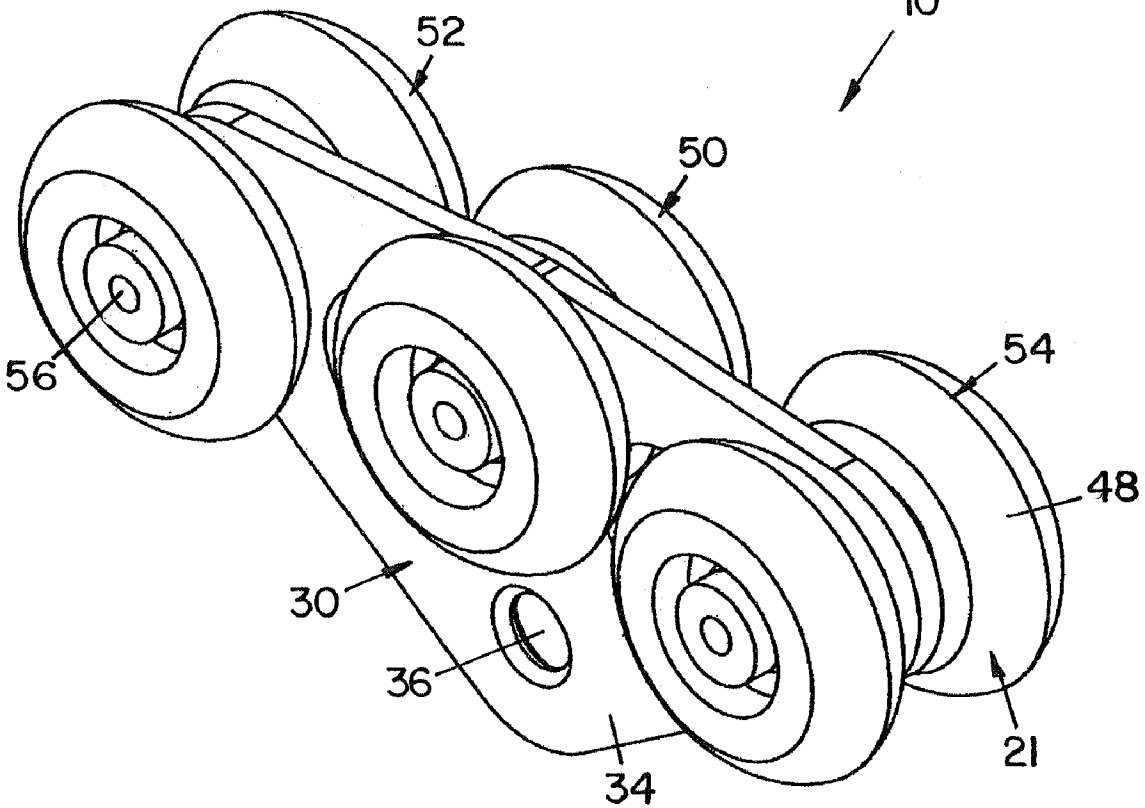
FIG. 3 is an isometric view of the trolley according to the first embodiment of the present invention.

FIG. 1 illustrates a first embodiment of the present invention. The apparatus includes a trolley 10 arranged for movement along a rail assembly 12. The rail assembly 12 is made up of rail members 14 attached to either side of a mounting member 18. The mounting member 18 serves to connect the two rail members 14 and provide a means by which the rail assembly 12 can be mounted to support members 20. The rail members 14 each have a shoulder portion 22 with perpendicular ledges 24 and 26 for engaging the mounting member 18. Each rail member also has a channel portion 28 along which the trolley 10 can move. The trolley 10 has wheels 21 supported on either side of a body 30 so that the trolley 10 can roll along the channel portions 28 of the rail members 14. The wheels 21 are supported on the body 30 such that the body extends outward from an space 32 provided between the two rail members 14. As seen in FIGS. 2 and 3, a hole 36 in this extending portion 34 of the trolley body 30 provides a means for attaching a load to the trolley 10. The trolley body 30 is made of a flat plate of a predetermined thickness having the necessary strength to handle loading of the trolley 10.

The channel portion 28 of each of the rail members 14 features a generally C-shaped cross section having an inner edge 38. This inner edge 38 outlines the shape of the channel through which the wheels 21 of the trolley travel. The channels are shaped such that each channel has a two opposing bearing surfaces 40. Each bearing surface 40 engages at least one of the wheels 21 of the trolley and features a central portion 44 and two side portions 46. The collective shape of the central 44 and side portions 46 corresponds to the curve of the radially outermost surface 48 of the wheels 21 such that a wheel can sit flush against one of the bearing surfaces 40. The engagement of the wheels 21 and rail members 14 over opposing curved areas means that the trolley 10 can handle loading in multiple directions, except for forces exerted along the rail assembly 12, which will instead cause the trolley 10 to move therealong.

The wheels 21 of the trolley 10 are supported in pairs spaced along the length of the trolley body 30. A central pair 50 is supported at the longitudinal center of the trolley body 30 while side pairs 52 and 54 are supported at either end thereof. The two wheels 21 of any single pair 50, 52 or 54 are supported on opposite sides of the body 30 on a wheel shaft 51 the center of which defines their axis of rotation 56. The wheels 21 have a diameter that is smaller than the distance between the bearing surfaces 40 of a single channel so that engagement between a wheel 21 and one of the bearing surfaces 40 will leave a space 58 between the wheel 21 and the opposite bearing surface of the same channel. This is necessary as contact with both of the bearing surfaces 40 would prevent rotation of the wheels 21 and eliminate the ability of the trolley 10 to move smoothly along the rail assembly 12.

Figure 4:
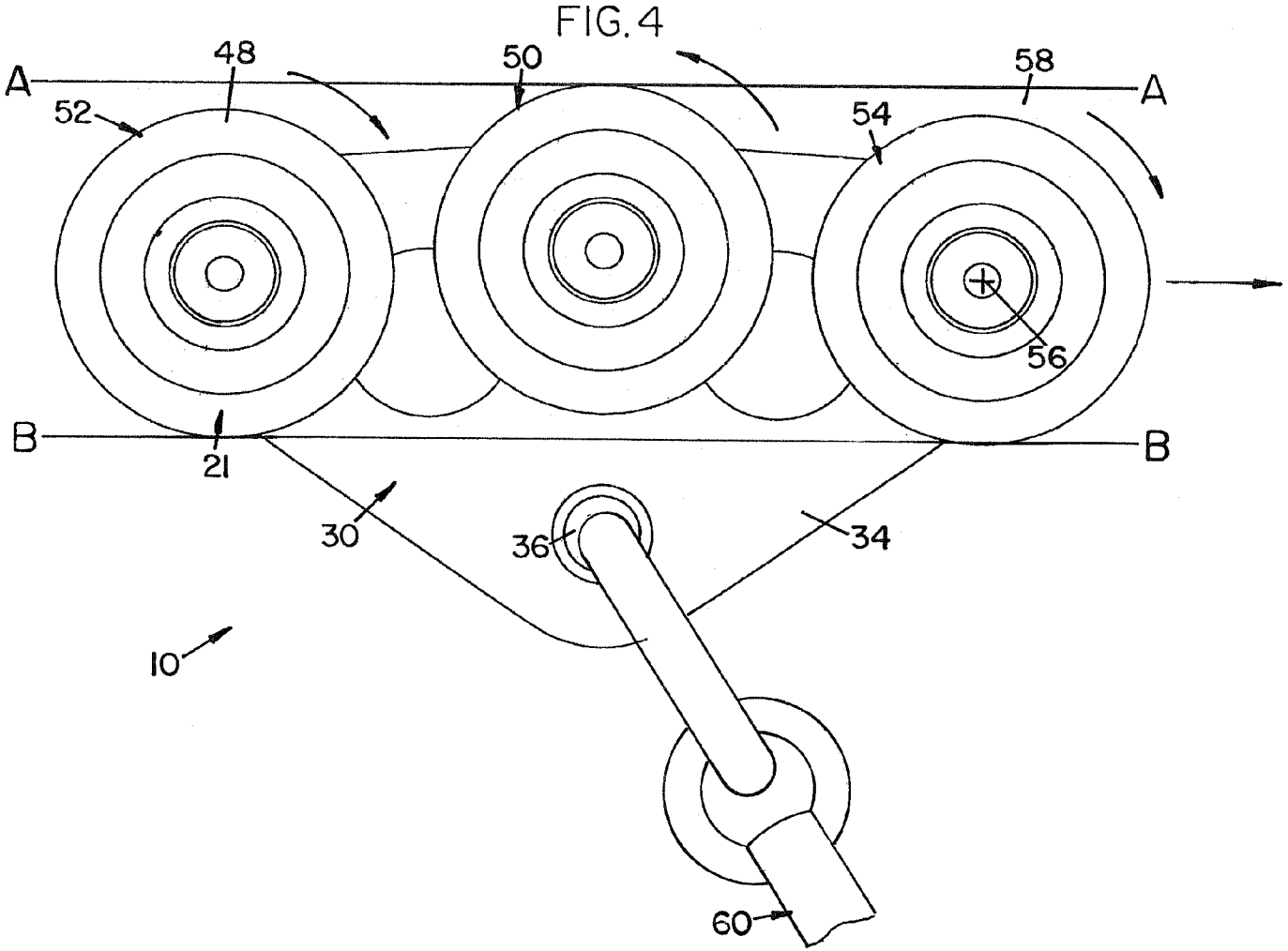
FIG. 4 is a side elevational view illustrating the rolling motion of the trolley according to the first embodiment of the present invention.

The rotational axis 56 of the central pair 50 of wheels 21 in the middle of the trolley 10 is offset from that of the side pairs 52 and 54 at either end in order to maintain a constant orientation of the trolley 10 with respect to the rail assembly 12. Contact between the central pair 50 of wheels 21 and one of the bearing surfaces 40 maintains constant spacing between the side pairs 52 and 54 of wheels 21 and the opposite bearing surface, thereby preventing any rocking or rotational motion of the trolley 10 about a transverse axis thereof within the channel portions 28 of the rail members 14. FIG. 4 illustrates the rolling motion of the trolley 10. To remove clutter and simplify the drawing, the rail assembly 12 is not shown. Instead, lines A-A and B-B are used to represent the central portions 44 of the opposing bearing surfaces 40 of the rail members 14. A lanyard 60 being used to carry a load (not shown) on the trolley 30 is pulled in the direction shown. This action induces clockwise rotation of the side pairs 52 and 54 of wheels 21 at either end of the trolley 10 due to engagement with a respective one of the bearing surfaces 40 of each channel (represented by B-B). The pulling action also induces counter clockwise rotation of the central pair 50 of wheels 21 due to engagement with the opposite bearing surface of each channel (represented by A-A). This rotational motion of the wheels 21 results in a smooth rolling motion of the trolley 10 along the rail assembly 12 in the direction shown by the arrow.

As a result of the bearing surfaces 40 of each channel being shaped to fit flush against the curved radially outermost surface 48 of the wheels 21 and the wheels being arranged to remain in constant contact with these surfaces, the rail assembly 12 of the present invention can be mounted in a variety of horizontal orientations. The rail assembly 12 can be mounted such that the trolley body 30 extends vertically downward, vertically upward, horizontally or at any angle in between. While the force exerted on the trolley by a fall will always be in a downward direction, the portion(s) of the bearing surfaces 40 which bear the force will differ depending on the orientation of the rail assembly 12. Force may be applied by the wheels 21 to the central 44 or either of the side portions 46 of one or more of the bearing surfaces 40 and 42 of the rail members 14. This allows the present invention to be mounted in a number of different orientations, thereby providing improved versatility and flexibility over the prior art.

Figure 5:
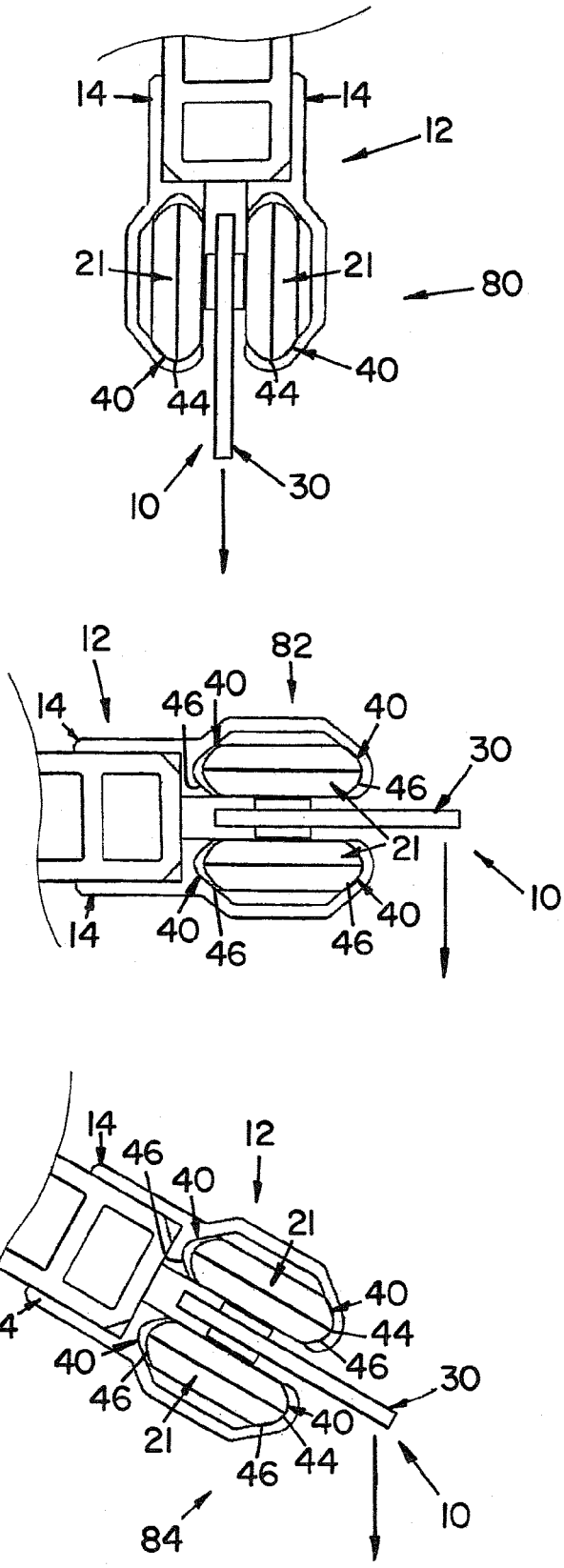
FIG. 5 contains end elevational views of the trolley and the rail assembly of the apparatus according to the first embodiment of the present invention as mounted in different orientations.

FIG. 5 illustrates three examples of different possible mounting orientations of the present invention. In each illustrated case, the vertical arrow represents a force exerted on the trolley by a load (not shown) supported thereon. If the rail assembly 12 is mounted such that the trolley body 30 extends vertically downward, as generally indicated by 80, the load is supported by means of the wheels 21 bearing against the central portion 44 of the lowermost one of the bearing surfaces 40 of each rail member 14. If the rail assembly 12 is mounted such that the trolley body 30 extends horizontally, as generally indicated by 82, the load is supported by means of the wheels 21 bearing against one of the side portions 46 of each bearing surface 40 of the rail members 14. If the rail assembly 12 is mounted such that the trolley body 30 extends neither horizontally nor vertically, as generally indicated by 84, the load is supported by means of the wheels 21 bearing against the side portions 46 of the bearing surfaces 40 as well as the central portion 44 of the lowermost one of the bearing surfaces 40 of each rail member 14.

Figure 6:
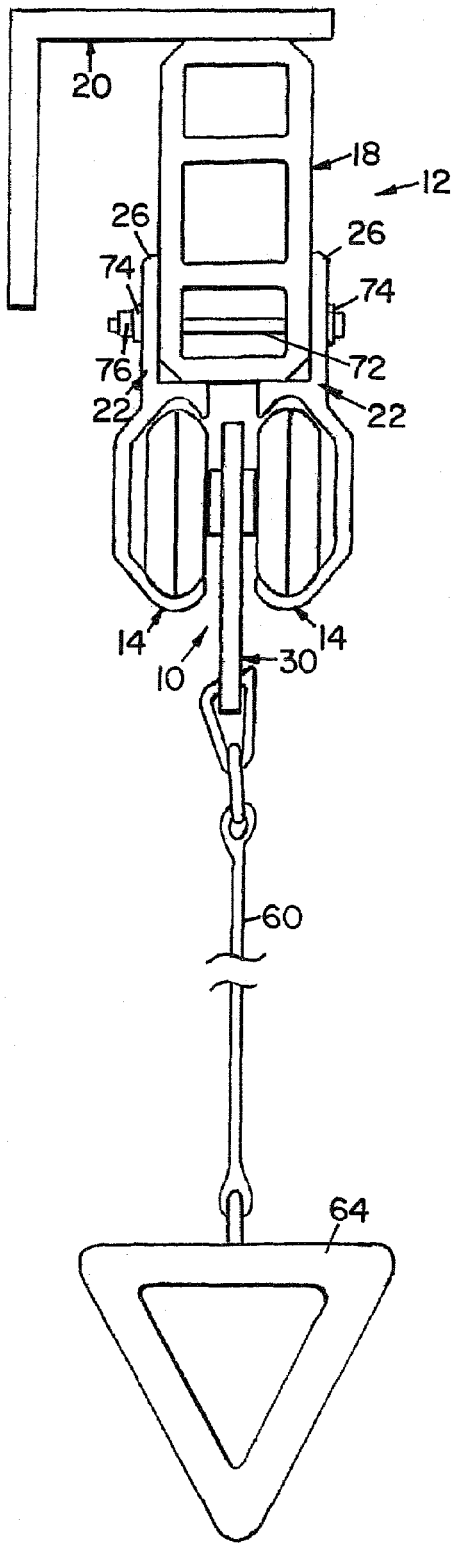
FIG. 6 is an end elevational view of the apparatus according to a second embodiment of the present invention in which the apparatus includes a lanyard and a harness as used in typical fall protection systems.

FIG. 6 illustrates a second embodiment of the invention which further includes a lanyard 60 supported on the trolley body 30. The lanyard 60 is connected at an end opposite the trolley 10 to a harness 64 adapted to be worn by a worker (not shown). In this embodiment, the present invention can be installed for use as a fall protection system for arresting an accidental fall of a worker from an elevated surface. Lanyards and harnesses are readily available and well known to those of skill in the art, and therefore not described here in detail. This embodiment also illustrates the means by which the rail members 14 are attached to the mounting member 18. A bolt 72 is passed through washers 74 and aligned holes cut through the longer ledges 26 of the shoulder portions 22 of the rail members 14 to engage a nut 76. Such fastening arrangements are provided along the rail assembly 12 at predetermined distances so as to support the rail members 14 on the mounting member 18 during loading of the trolley 10. Alternate means of connecting components of an apparatus are well known to those of skill in the art.

Figure 7:
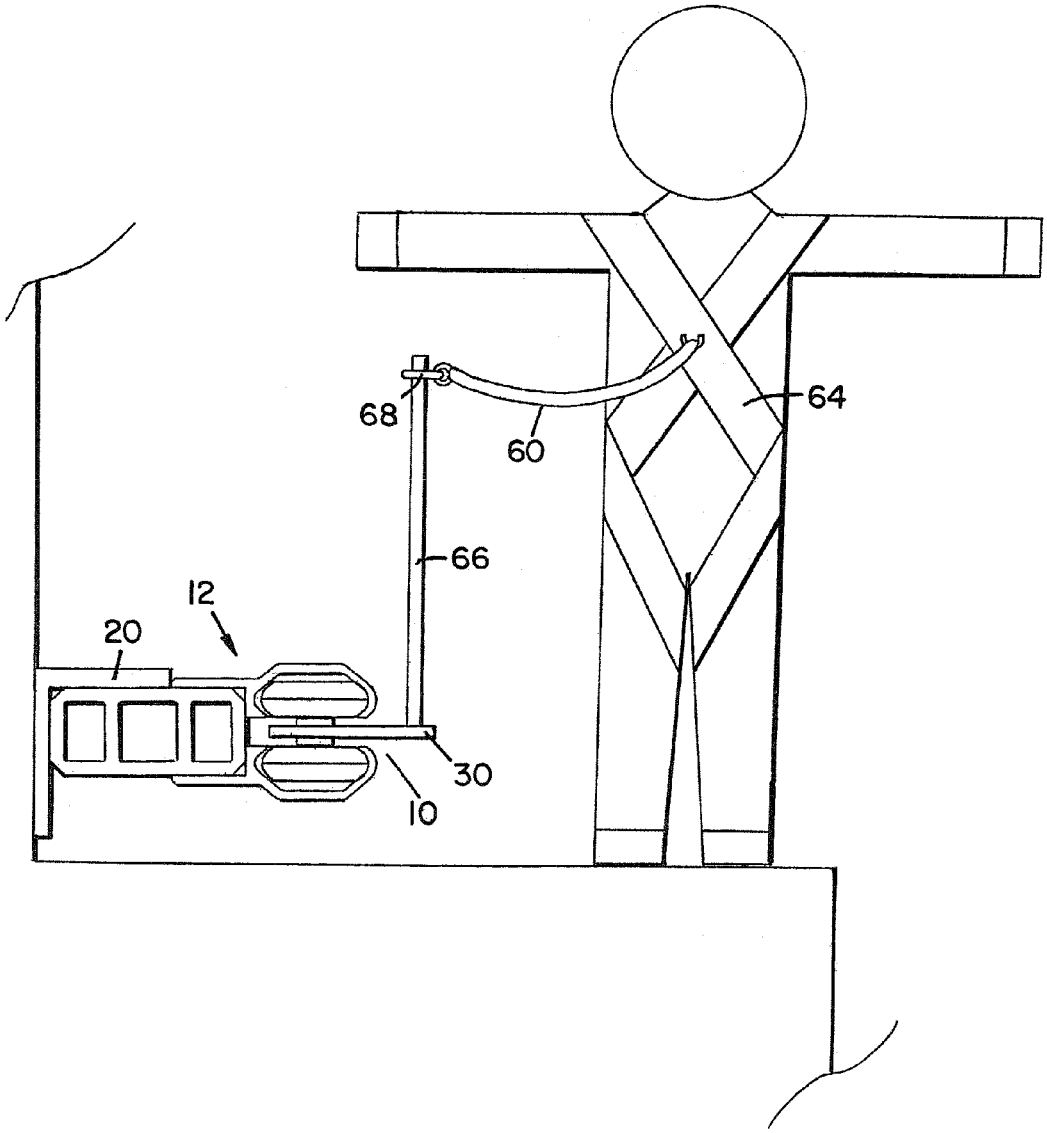
FIG. 7 is an end elevational view of the apparatus according to a third embodiment of the present invention in which the apparatus is used as a fall protection system mounted at the user's feet.

A third embodiment, mounted at the worker's feet for fall protection in situations where mounting the rail assembly 12 at a higher elevation may not be practical, is shown in FIG. 7. While a typical fall protection system mounted at the user's feet can prevent serious injury or death, such a system is not as effective as an overhead system, as the user is subject to a longer vertical drop before the fall is arrested. This embodiment of the present invention provides a rigid vertical bar 66 attached to the extending portion 34 of the trolley body 30 in order to provide a lanyard attachment point 68 significantly above the trolley 10. In this case, even though the rail assembly 12 is mounted at the user's feet, the lanyard 60 connects to the apparatus at the elevated attachment point 68 so that in the case of a fall, the apparatus will have an effectiveness closer to that of an overhead system where the fall is arrested quickly with little vertical drop. This is a noteworthy embodiment, as shorter falls are less likely to cause bodily harm due to the jerking motion experienced when the fall is arrested, as the user is exposed to gravitational acceleration for less time.

Figure 8:
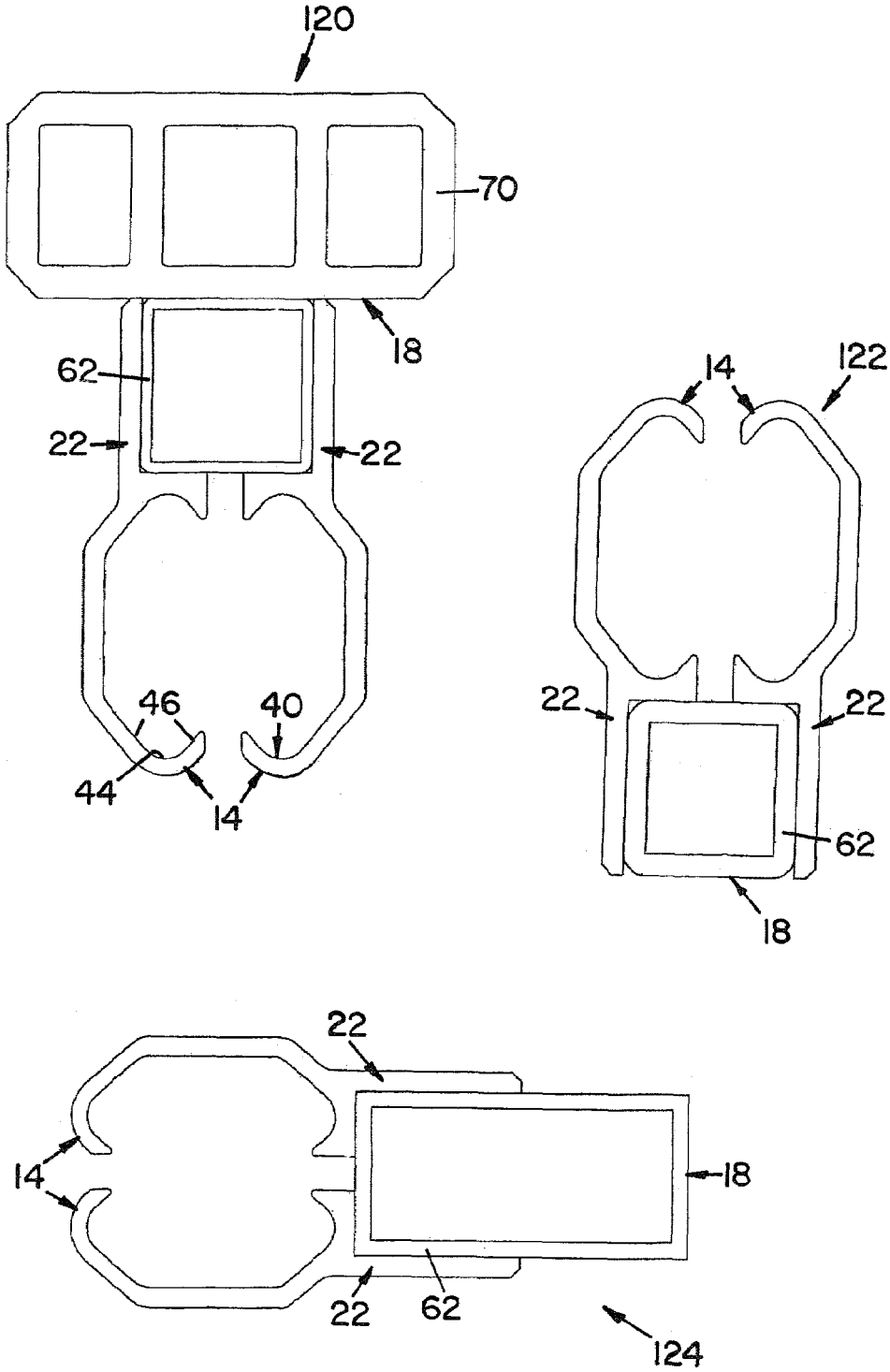
FIG. 8 is an end elevational view of rail assemblies according to alternate embodiments of the present invention, each having different style of mounting member.

The present invention can be easily adapted for different mounting arrangements simply by changing the longitudinal mounting member 18 on which the rail members 14 are supported. As shown in FIG. 8 by the rail assemblies of three alternate embodiments of the present invention, any mounting member 18 having an engagement portion 62 with a cross section of appropriate rectangular dimensions can be mounted between the shoulder portions 22 of the rail members 14. In the rail assembly generally indicated by 120, the mounting member 18 features an extension portion 70 mounted to the rectangular portion 62, the cross section of the extension portion 70 extending outward past the rail members 14 on either side. In the rail assembly generally indicated by 122, the rectangular engagement portion 62 makes up the entire mounting member 18 which is therefore located entirely between the shoulder portions 22 of the rail members 14. In the rail assembly generally indicated by 124, the mounting member 18 has an elongated rectangular cross section extending outward from the engagement portion 62 between the shoulder portions 22.

Figure 9:
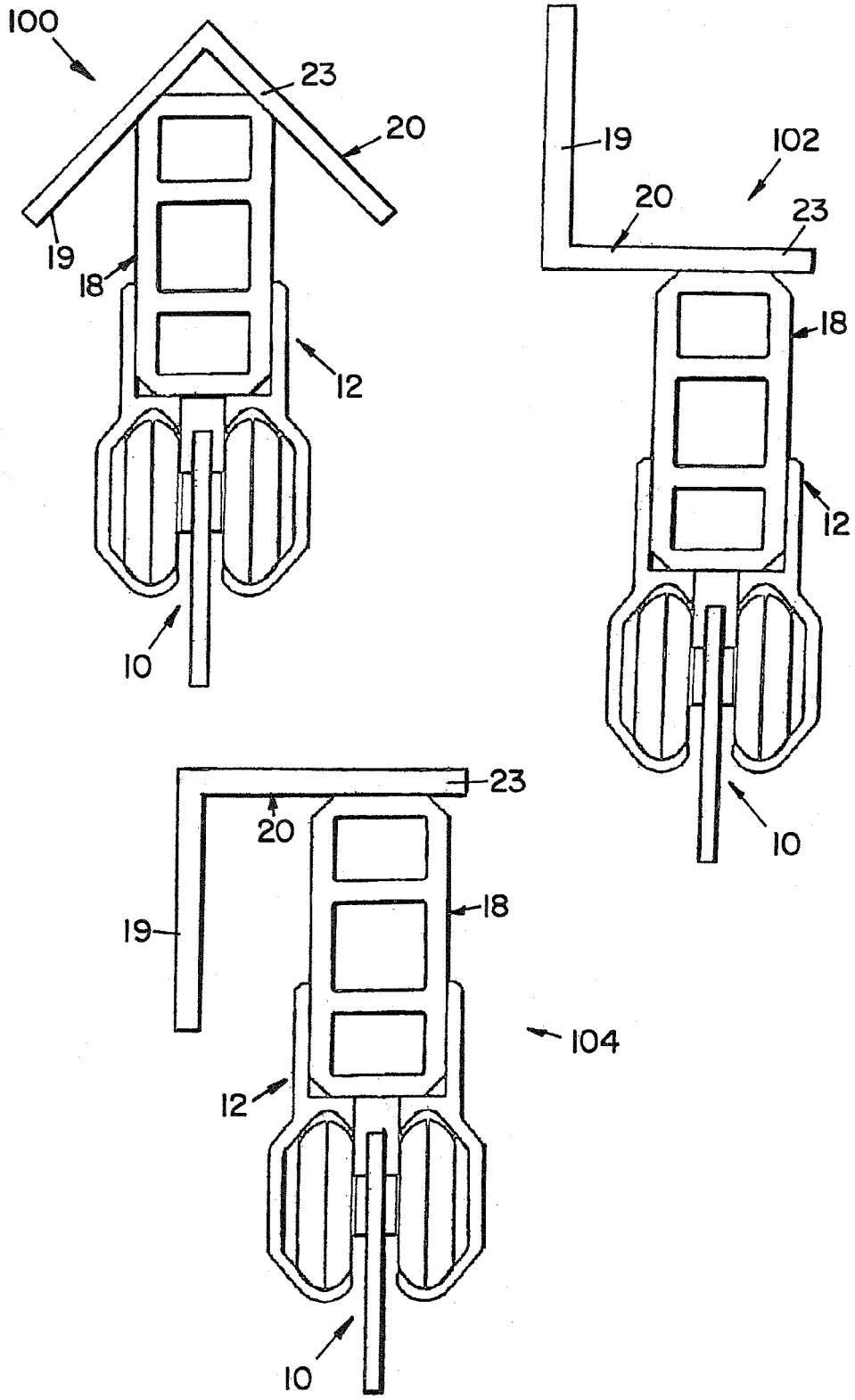
FIG. 9 is an end elevational view of additional alternate embodiments of the present invention, each having the rail assembly mounted in a different position on the support member.

FIG. 9 shows alternate embodiments of the present invention to illustrate different possible mounting arrangements of the rail assembly 12 using a right angled support member 20. The mounting arrangement generally indicated by 100 has the mounting member 18 attached to each arm 19 and 23 of the mounting member 20 such that the cross section of the rail assembly 12 bisects the right angle between the arms. Such an arrangement is useful in such a case in which it is desirable to mount the apparatus in a corner. In this case, each arm 19 and 23 of the support member 20 can be attached to the converging surfaces forming the corner. The mounting arrangement generally indicated at 102 has the mounting member 18 attached to one arm 23 of the support member 20 such that the cross section of the rail assembly 12 extends in a direction opposite the other arm 19, which can be mounted on an appropriate external surface. The mounting arrangement generally indicated by 104 has the mounting member 18 attached to one arm 23 of the support member 20 such that the cross section of the rail assembly 12 extends in the same direction as the other arm 19. This allows the mounting of each arm 19 and 23 to a respective external surface, if so desired. Many alternate means of supporting a rail based system are well known to those of skill in the art and can be readily applied to the present invention. These include a single continuous support member spanning the length of the rail assembly and multiple support members spaced therealong. For example, the support members may be chains attached to the mounting member at predetermined distances therealong for suspending the apparatus from an overhead surface.

The mounting member 18 and rail members 14 are extruded pieces made by means of extrusion processes known to those of skill in the art. This allows each of the rail members 14 to be produced as one rigid longitudinal piece having the cross sectional shape necessary to form the channel 28 and shoulder 22 portions for form fitting engagement with the trolley wheels 21 and mounting member 18 respectively.

While the trolley has been described as having three pairs of wheels radially spaced therealong, it could be easily adapted to have additional pairs if desired. The only requirement is that at two nonadjacent pairs engaging the same bearing surface are separated by at least one pair engaging the opposite bearing surface. This arrangement will prevent rotation of the trolley about an axis transverse to the rail assembly while allowing smooth rolling motion therealong.

As previously mentioned, it should be noted that the track and trolley system described can be used for purposes other than fall protection. Any application requiring the suspension of a load above a surface where linear movement would be desirable could make use of such a system. As a result, the claims are not limited to a fall protection system in which a worker the trolley is connected to a worker wearing a safety harness by means of a lanyard. Instead the claims describe an apparatus having a trolley capable of carrying a load and being movable along the rail assembly.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. An apparatus comprising:

a longitudinal rail assembly mounted on support members, said members arranged such that said rail assembly is generally horizontal;

a trolley for carrying a load, said trolley being movable along the rail assembly;

the trolley comprising a body, a center pair of wheels and two side pairs of wheels, said center pair being disposed in a radial space between said side pairs, each pair being rotatable about a respective axis, the wheels of each pair being disposed on opposite sides of said body;

the rail assembly having two longitudinal channels therein, each channel arranged to receive a respective one wheel of each pair;

the channels being laterally spaced such that the body of the trolley can be received therebetween for movement therealong;

each channel being defined by at least a first bearing surface and a second bearing surface, said bearing surfaces being arranged opposite one another;

each bearing surface comprising a central section and two side sections, each side section being disposed on an opposite side of said central section, the side sections of the first bearing surface extending toward the second bearing surface and vice versa;

each wheel being of a shape such that said wheel engages the central and side sections of one of the bearing surfaces, thereby resisting loading of the trolley in multiple directions;

wherein a distance between the central sections of the first and second bearing surfaces of each channel is greater than a diameter of the respective one wheel of each pair such that said wheel engages only one of said bearing surfaces, thereby allowing rotation of said wheel for movement of the trolley along the rail assembly;

the axis of each side pair of wheels intersecting with a first longitudinal axis of the rail assembly and the axis of the center pair of wheels intersecting with a second longitudinal axis of said rail assembly, said longitudinal axes being spaced apart such that said side pairs engage the first bearing surface and said central pair engages the second bearing surface, the axes of the side pairs of wheels and the center pair of wheels being parallel.

2. The apparatus according to claim 1 wherein the rail assembly comprises two longitudinal rail members each having a respective one of the two channels therein.

3. The apparatus according to claim 2 wherein each longitudinal rail member comprises an extruded rail member.

4. The apparatus according to claim 2 wherein the rail assembly further comprises a longitudinal mounting member, said longitudinal mounting member being attached to each of the two rail members.

5. The apparatus according to claim 4 wherein the longitudinal mounting member comprises an extruded mounting member.

6. The apparatus according to claim 4 wherein the longitudinal mounting member is attached to the support members for supporting the rail assembly.

7. The apparatus according to claim 4 wherein each longitudinal rail member comprises a shoulder portion for engagement with the longitudinal mounting member.

8. The apparatus according to claim 2 wherein each longitudinal rail member comprises a channel portion having a generally C-shaped cross section, said channel portion having an inside surface defining the first and second bearing surfaces of the respective channel.

9. The apparatus according to claim 8 wherein the C-shaped cross section of the channel portion of each longitudinal rail member defines an open side of said rail member, the longitudinal rail members being arranged such that the open sides of said rail members face one another.

10. The apparatus according to claim 4 wherein the longitudinal mounting member comprises a cross section having a generally rectangular perimeter.

11. The apparatus according to claim 4 wherein the rail members are bolted to the longitudinal mounting member.

12. The apparatus according to claim 10 wherein the rail members are bolted to the longitudinal mounting member through the shoulder portion of each rail member.

13. The apparatus according to claim 1 wherein there is provided a lanyard supported on the trolley for connecting the load being carried to said trolley.

14. The apparatus according to claim 13 wherein there is provided a harness supported on the lanyard for engaging the load being carried and connecting said load to said lanyard.

15. The apparatus according to claim 1 wherein the trolley body comprises a generally flat plate.

16. The apparatus according to claim 1 wherein the trolley body has a hole therein such that the load can be connected to the trolley by means of said hole.

17. The apparatus according to claim 1 wherein there is provided a rigid member extending upward from the trolley body for providing a connection point above the trolley to which the load can be connected.

18. An apparatus comprising:

a longitudinal rail assembly mounted on support members, said members arranged such that said rail assembly is generally horizontal;

a trolley for carrying a load, said trolley being movable along the rail assembly;

the trolley comprising a body having at least three pairs of wheels supported thereon, said pairs of wheels being radially spaced apart, each pair being rotatable about a respective axis, the wheels of each pair being disposed on opposite sides of said body;

the rail assembly having two longitudinal channels therein, each channel arranged to receive a respective one wheel of each pair;

the channels being laterally spaced such that the body of the trolley can be received therebetween for movement therealong;

each channel being defined by at least a first bearing surface and a second bearing surface, said bearing surfaces being arranged opposite one another;

each bearing surface comprising a central section and two side sections, each side section being disposed on an opposite side of said central section, the side sections of the first bearing surface extending toward the second bearing surface and vice versa;

each wheel being of a shape such that said wheel engages the central and side sections of one of the bearing surfaces, thereby resisting loading of the trolley in multiple directions;

wherein a distance between the central sections of the first and second bearing surfaces of each channel is greater than a diameter of the respective one wheel of each pair such that said wheel engages only one of said bearing surfaces, thereby allowing rotation of said wheel for movement of the trolley along the rail assembly;

the axes of the pairs of wheels being arranged such that at least one pair of wheels engaging the second bearing surface is located in a radial space between two nonadjacent pairs of wheels engaging the first bearing surface, the axes of the at least three pairs of wheels being parallel.

* * * * *

UNITED STATES PATENT AND TRADEMARK OFFICE

CERTIFICATE OF CORRECTION

PATENT NO. : 7,603,952 B2
APPLICATION NO. : 11/183241
DATED : October 20, 2009
INVENTOR(S) : Jan Vetesnik It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 388 days.

Signed and Sealed this

Fourteenth Day of December, 2010

David J. Kappos

David J. Kappos
*Director of the United States Patent and Trademark Office*